US006279359B1

(12) United States Patent
Boisvert

(10) Patent No.: US 6,279,359 B1
(45) Date of Patent: Aug. 28, 2001

(54) DISLODGE LEVER ASSEMBLY FOR SURFACE MOUNTABLE SAFE

(75) Inventor: David P. Boisvert, Southington, CT (US)

(73) Assignee: Mossberg Safe Systems, Inc., North Haven, CT (US)

( * ) Notice: Subject to any disclaimer, the term of this patent is extended or adjusted under 35 U.S.C. 154(b) by 0 days.

(21) Appl. No.: 09/352,220

(22) Filed: Jul. 13, 1999

Related U.S. Application Data

(60) Provisional application No. 60/092,745, filed on Jul. 14, 1998.

(51) Int. Cl.[7] ..... E05B 73/00; E05G 1/04

(52) U.S. Cl. ..... 70/63; 109/51; 109/52; 248/551

(58) Field of Search ..... 109/50, 51, 52; 70/58, 62, 63; 248/551, 553; 232/4 D, 15, 16, 31, 32

(56) References Cited

U.S. PATENT DOCUMENTS

| | | | | |
|---|---|---|---|---|
| 1,203,282 | * | 10/1916 | Uth | 109/52 |
| 1,240,981 | * | 9/1917 | Kohl | 109/52 X |
| 1,682,135 | * | 8/1928 | Mann, Jr. | 109/51 X |
| 1,796,502 | * | 3/1931 | Boucher | 109/51 X |
| 1,869,302 | * | 7/1932 | Brosnan | 109/52 |
| 3,741,132 | * | 6/1973 | Blower | 109/52 |
| 4,249,684 | * | 2/1981 | Miller et al. | 109/51 X |
| 4,398,470 | * | 8/1983 | Williams et al. | 109/52 |
| 4,987,836 | * | 1/1991 | Owen | 109/52 |
| 5,607,102 | * | 3/1997 | Walsh et al. | 109/52 X |

FOREIGN PATENT DOCUMENTS

| | | | | |
|---|---|---|---|---|
| 344006 | * | 11/1921 | (DE) | 109/51 |
| 147121 | * | 10/1936 | (DE) | 109/51 |
| 636800 | * | 10/1936 | (DE) | 109/51 |
| 1017185 | * | 12/1952 | (FR) | 109/52 |

* cited by examiner

*Primary Examiner*—Lloyd A. Gall
(74) *Attorney, Agent, or Firm*—St. Onge Steward Johnston & Reens LLC

(57) ABSTRACT

A safe assembly includes a portable lockable enclosure, a mounting plate for securing the lockable enclosure to a stationary surface, and a latching element actuatable from an interior of the safe assembly to detach the lockable enclosure from the mounting plate for further travel or relocation. The latching element has a latch assembly engaging a pair of brackets extending from the mounting plate into the interior of the safe assembly and a release assembly enabling disengagement of the latch assembly.

21 Claims, 5 Drawing Sheets

10
14
27
60
62
64
66
68
70
72
74
76
77
80
81
82
83
84
85
88
90
96

DISLODGE LEVER ASSEMBLY FOR SURFACE MOUNTABLE SAFE

PRIOR APPLICATION

This application is a continuation-in-part of Provisional Application of U.S. No. 60/092,745 filed on Jul. 14, 1998 and which is fully incorporated herein by reference thereto.

FIELD OF THE INVENTION

The present invention relates to safe assemblies, and, in particular, to safe assemblies which can be detachably mounted on a support surface. Specifically, the present invention relates to a dislodge lever assembly capable of disengaging the safe assembly from a mounting plate secured to a support surface in an efficient manner.

BACKGROUND OF THE INVENTION

In light of an ongoing debate about whether a firearm in the home is more likely to protect or endanger a family of its owner and an owner herself, it is imperative that a firearm safe be securely mounted to a support surface to prevent its relocation by unauthorized persons. The art does supply a number of small portable safes, which may be mounted on support surfaces.

U.S. Pat. No. 4,768,021 (Ferraro) discloses a portable safe for containing guns including a receptacle which has a bottom providing a mounting plate. The mounting plate has a mounting hole for use in attaching the safe to other structures. A pressure sensitive pad is affixed to the mounting plate at the mounting hole and is positioned to be overlapped by the head of a mounting screw. When unauthorized forceful pulling is applied to the portable safe seeking to dislodge it from the other structures, a bolt head of a fastener mounted on the mounting plate applies a force to a pad that sets off an alarm system.

U.S. Pat. No. 5,056,342 (Prinz) describes a security container specifically adapted to be mounted to the undersurface of a table, counter or other like structure, in a manner which will support and removably dispose the security container in a position where it is not readily visible. The security container is comprised of a mounting means removably securing the container to the bed frame and comprising two brackets each of which has an elongated mounting arm attached at a common, corresponding end of a head portion. Such attachment of the mounting arms occurs by a plurality of bolt and nut connectors passing through appropriately aligned apertures in the arms into a top of the container.

U.S. Pat. No. 4,890,466 (Cislo) teaches a safe for pistols having a fastener which allows it to be locked to any of standard bed frames supports. The safe is securely fastened to a bed frame by means of a detachable bracket which can be fixed to the frame only from the safe's interior by using conventional fasteners, such as bolts and screws.

All of the above discussed prior references teach conventional fastening means for attaching a mounting bracket to a housing that requires a screwdriver to dislodge the safe from the mounting bracket or a support surface.

SUMMARY OF THE INVENTION

With a dislodge lever assembly in accordance with the invention one can detach a safe from a mounting plate securing the safe to a support surface without use of a screwdriver or any other tools.

This is achieved by one release lever assembly of the invention by providing a safe with an opening receiving a mounting plate, sometimes referred to as a mounting bracket, and a latching element positioned with respect to the opening to releasably engage the mounting bracket. The latching element may be actuated only from an interior of the safe and includes a release lever pivotal to clear the opening upon applying an external force to allow the mounting bracket to slide through the opening out of engagement.

It is, therefore, an object of the invention to provide a lockable enclosure, which is securely attached to a support surface.

Another object of the invention is to provide the lockable enclosure, which is detachable from the support surface for further travel or relocation.

Still another object of the invention is to provide the lockable enclosure with a release lever assembly for detaching the lockable enclosure from the support surface.

Yet another object of the invention is to provide a latching element actuatable from an interior of the lockable enclosure in order to release a mounting bracket from engagement.

The above and other objects, features and advantages will become more readily apparent from the following description of the invention with references made to the accompanying drawings.

BRIEF DESCRIPTION OF THE DRAWINGS

FIG 1 is a cross sectional view of the latch assembly taken along lines IV—IV of FIG. 3 during attachment of the mounting plate to the safe.

FIG. 4A is a perspective view of a latch assembly.

DETAILED DESCRIPTION OF THE INVENTION

Figure 1:
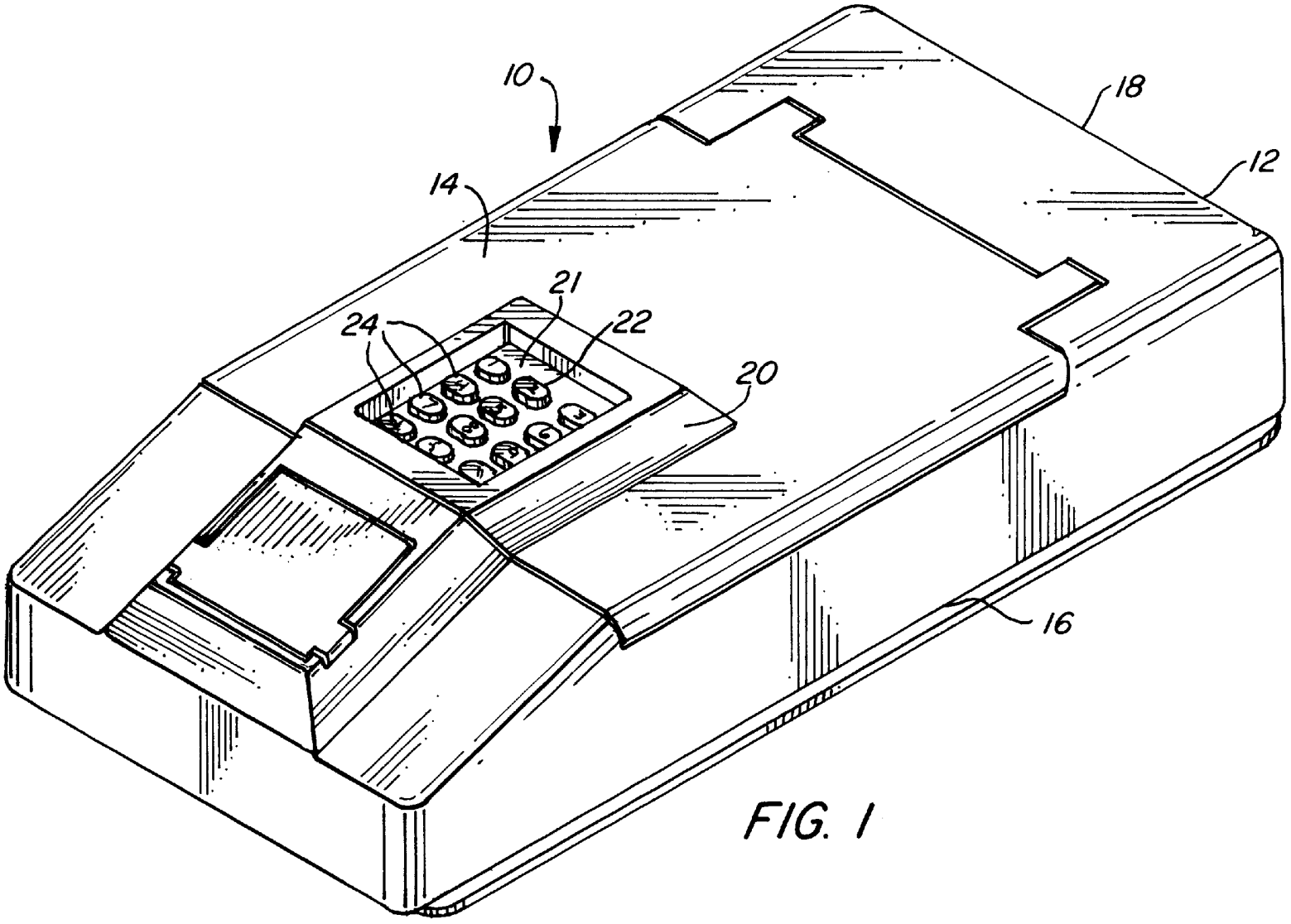
FIG. 1 an isometric view of a safe shown in its closed state and positioned on its bottom.
Figure 2:
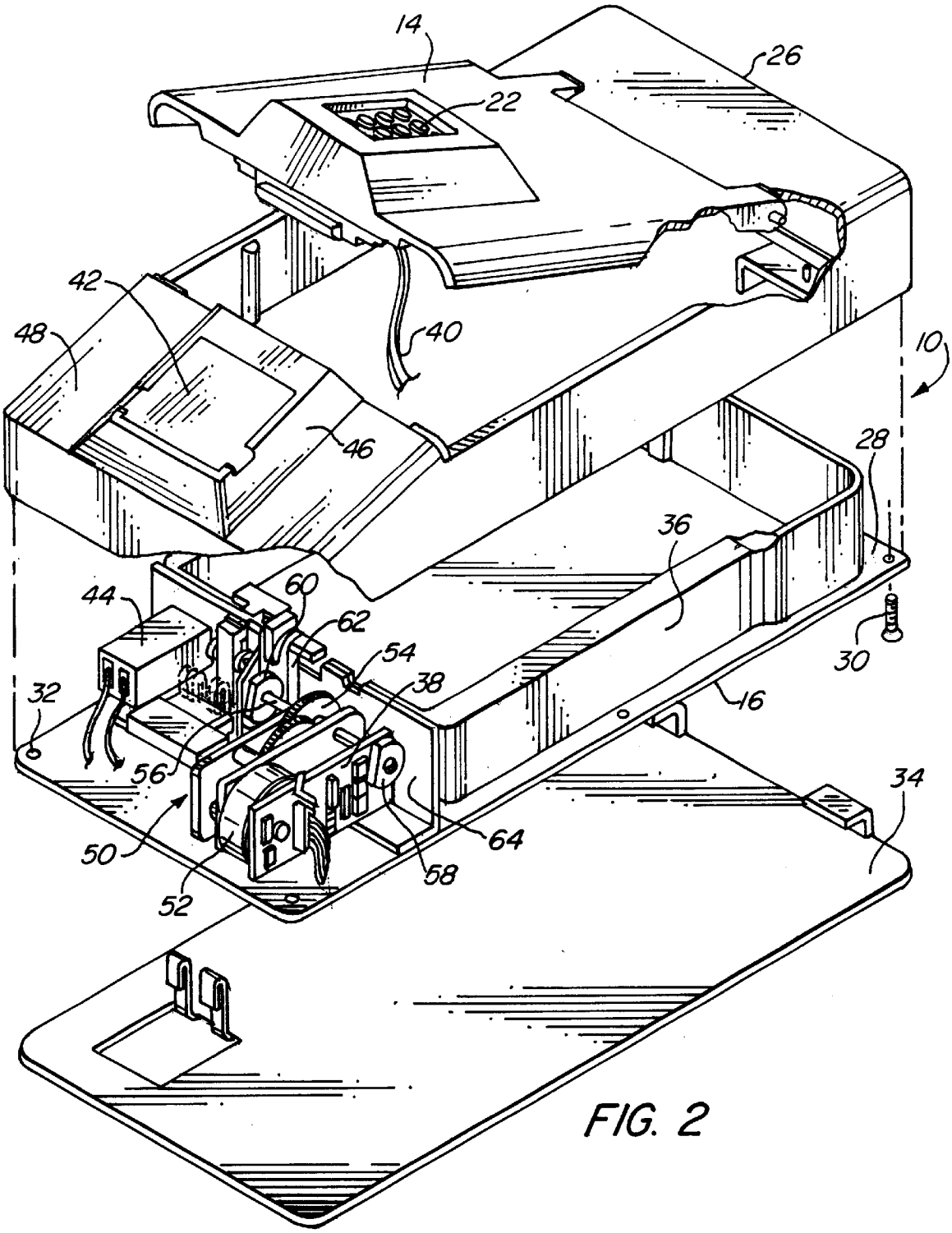
FIG. 2 is an exploded view of the safe of FIG. 1.
Figure 3:
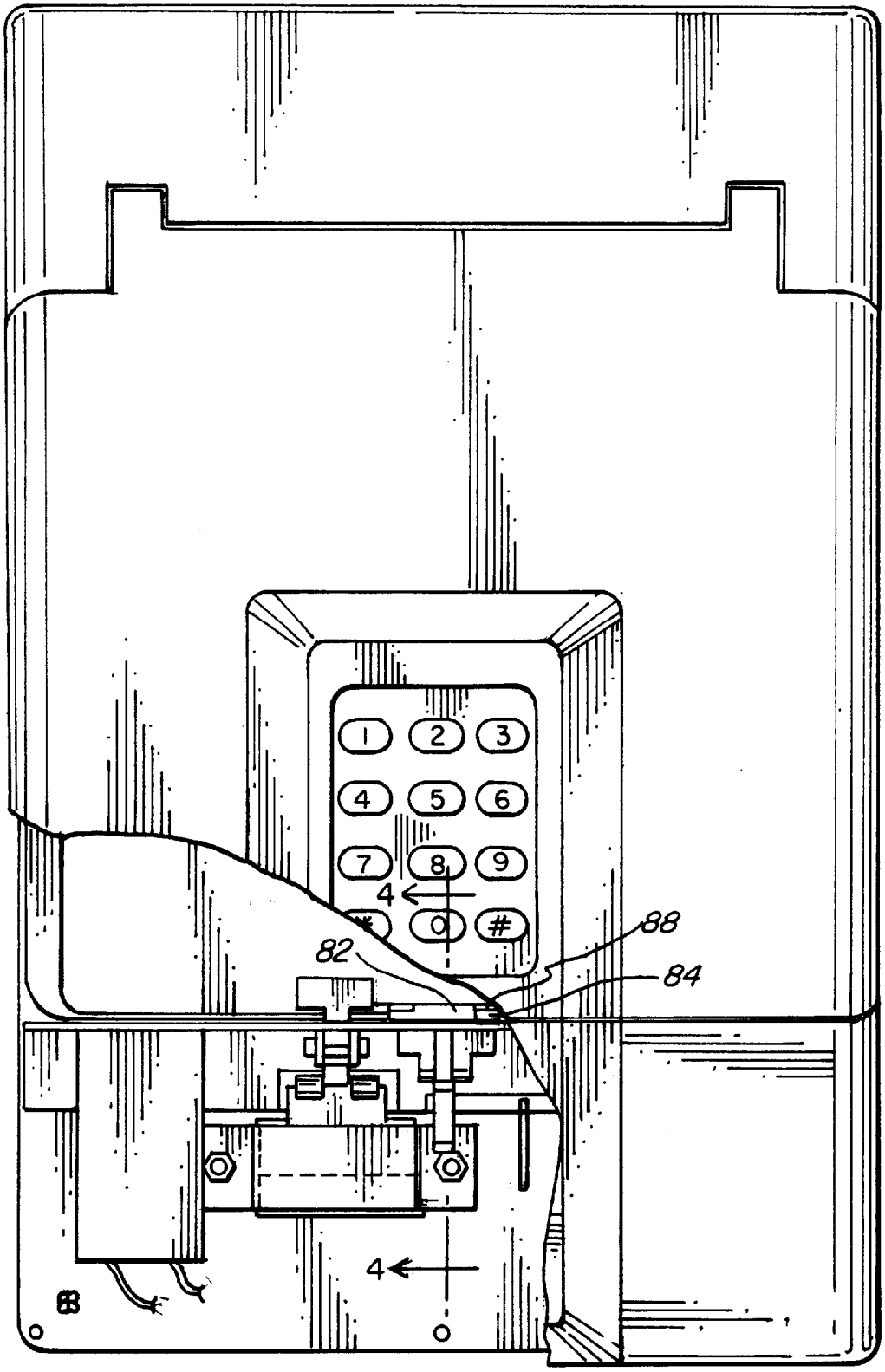
FIG. 3 is a view of the safe shown in FIG. 1 with a portion cut away for clarity.

Referring to FIGS. 1–3, a safe 10 is a self-contained, electronically controlled containment system for storing a variety of valuables, such as, for example, guns and the like. The safe 10 can be positioned on any generally flat surface juxtaposed with its bottom 16.

FIG. 1 illustrates the safe 10 shown in its locked state and having a solid cast lockable enclosure 12. A lid 14, sometime referred to as a door, is mounted to the enclosure 12 to move to an open position shown in FIG. 2. A formation extends from the lid 14 and defines a recess 21 that receives a keypad system 22 including a plurality of keys or buttons 24 used to customize a user's personal access code. As better seen in FIG. 3, the buttons are provided with standard numeric digits. By dialing the personal access code, a user may enable the door 14, as is disclosed in a coopending application Ser. No. 09/352,563 filed concurrently therewith, to gain access to an interior of the enclosure 12.

As shown in FIG. 2, the safe 10 substantially has a top wall 26 and a receptacle 28. In an assembled state of the safe 10, the top wall 26 and receptacle define an interior of the safe sized to receive the valuables. Any suitable fasteners may do assembly of the components of the safe top wall. In an illustrated example, screws 30 traverse aligned holes 32 that are formed in the top wall and the receptacle.

The receptacle 28 receives a cushioned receptacle tray 36 receiving the valuables. This cushioned receptacle tray is secured to the receptacle's bottom 29 and is made of light durable material, for example, plastic. An L-shaped support 27 extending across and from the receptacle's bottom 29 is fixedly mounted on it adjacent to the cushioned receptacle tray 36. This L-shaped support provides a bearing structure for various components of the safe 10.

In accordance with one aspect of the invention, the safe 10 further has a mounting bracket 34, which is removably attached to an underside of the safe's bottom 16 and which is preferably sized to conform to this bottom. Two spaced hooks 35 extending from a rear side of the mounting plate 34 have free bent ends 37 pointing toward a front side of the and adapted to slidably abut the bottom 29 of the receptacle 28 during assembly of the safe. One of the functions of the mounting plate 34 is to secure the enclosure 12 in a predetermined location, so as to avoid unauthorized relocation of the safe. To implement it, the mounting plate 34 is further provided with two spaced brackets 44 that extend through an opening 46, which is formed in the bottom 16, into the interior of the enclosure 12 upon mounting of the safe to a stationary surface (not shown here). Each of the brackets 44 has a main body 43 and U shaped free end 45 that has a thickness greater than that of the body to releasably engage the enclosure 12, as will be explained hereinbelow.

In accordance with another aspect of the invention, which is illustrated in FIG. 3, the safe 10 has a dislodge assembly 38 engaging the brackets 44 in. order to secure engagement between the mounting plate and the enclosure 12. The dislodge assembly 38 is comprised of a release assembly 40 mounted to the L-shaped support 27 and a latch assembly 42 mounted on the bottom 29 of the receptacle 28. Both assemblies are positioned close to the opening 46 and, as is shown in FIG. 3, provide engagement between brackets 44 of the mounting plate 34 with the enclosure as will be now explained in detail.

Figures 3A, 4, 5:
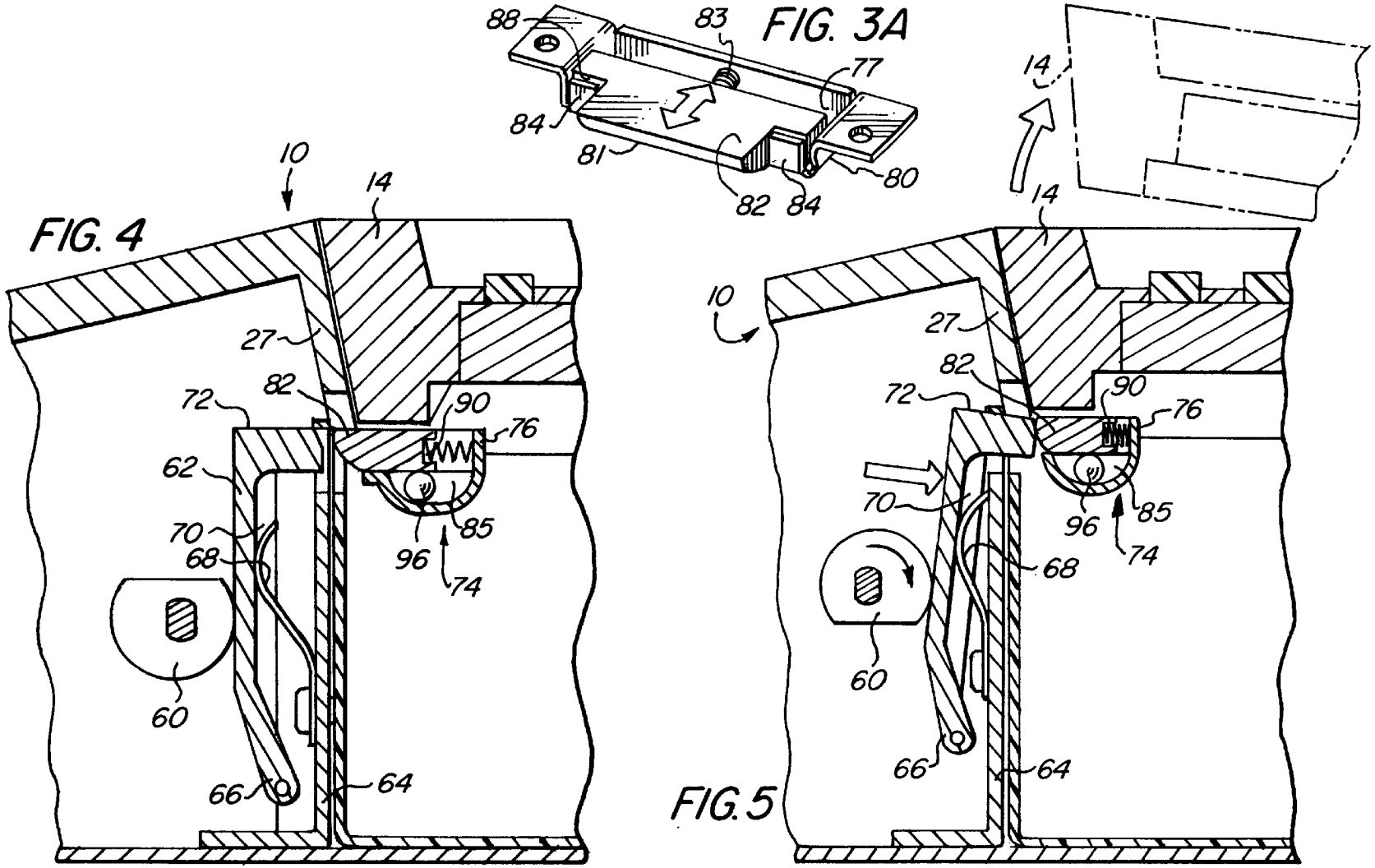
FIG. 5 is the same cross sectional but showing the safe that is fully attached to the mounting plate.
Figure 6:
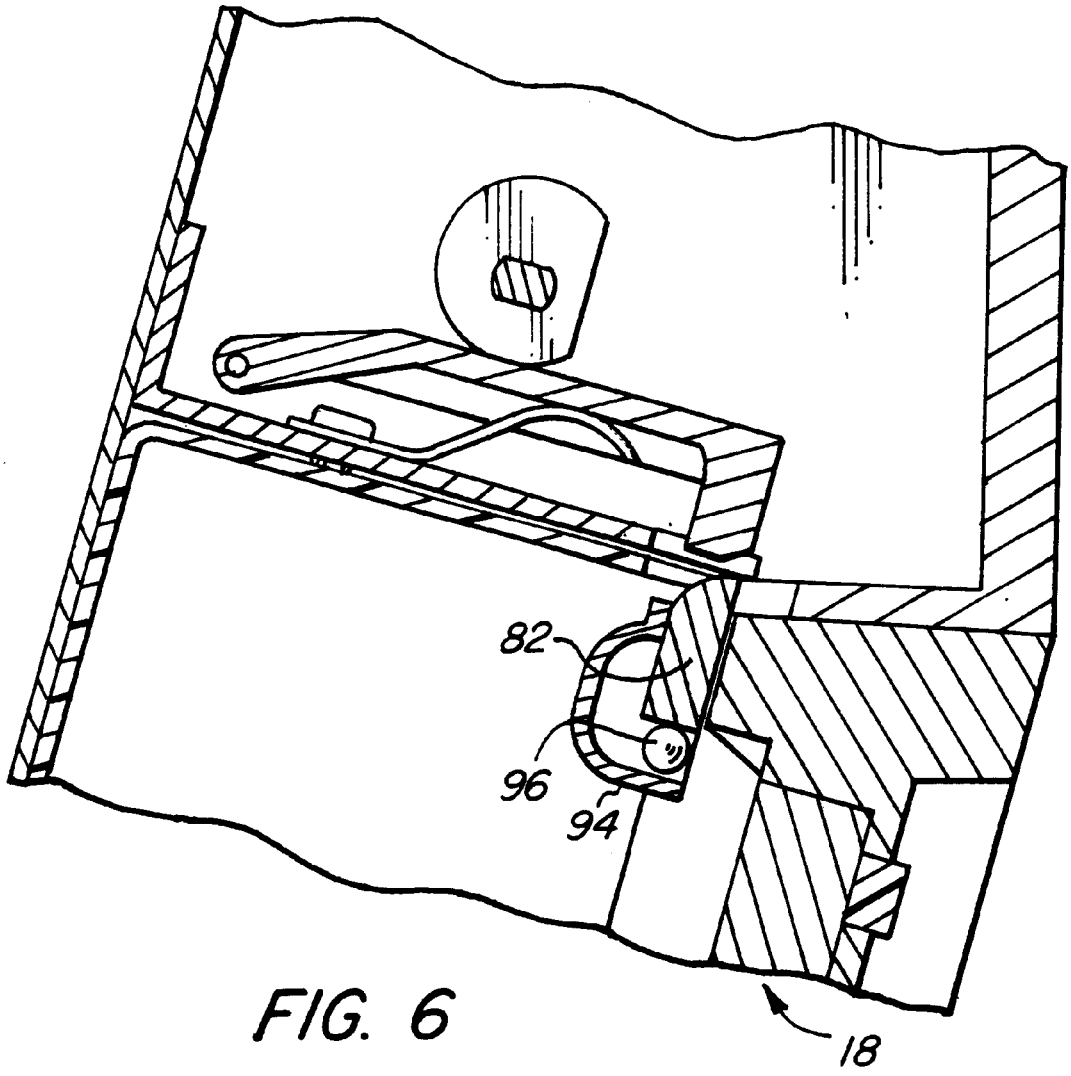
FIG. 6 is the same cross sectional view with a door enabling access to the safe's inter or open

Turning to FIGS. 4–6 and, particularly, to FIG. 5, the latch assembly 42 includes a housing 60 fixed to the bottom 29 of the receptacle 28 and positioned adjacent to the opening 46. The housing 60 receives a latch element 62 which is shaped as a plate and has a beveled end 64 that extends from the housing to cooperate with the brackets 44 of the mounting plate 34 during attachment of the mounting plate 34 to the enclosure 12. A bias element 66 completes the latch assembly by having its opposite ends braced against the housing 60 and the latch element 62. As a consequence, the latch element 62 is biased toward the opening 46, so that when the brackets 44 are inserted into the opening 46 its free ends 45 rest atop the latch element 62 whereas the beveled edge 64 urges against bodies 43 of the brackets.

In order to disengage the latch assembly 42, according to another aspect of the invention, the release assembly 40 is pivotally mounted in the interior of the enclosure 12 to swing in a position wherein it actuates the latch element 62 so it can retract into the housing 60. Turning to FIG. 3, the release assembly is comprised of two spaced brackets 54 fixed on the L-shaped support 27 and rotatably receiving a pin 52. Returning to FIG. 4, the release assembly further comprises a release lever 56 receiving the pin 52 fixed to the release lever substantially midway between its opposite ends 50, 51. The release lever substantially has a Z shape with the upper lever end 50 extending through a recess 33 in the L-shaped support 27 into the cushioned receptacle tray 36 and with the lower lever end 51 extending over the opening 46 toward the beveled edge 64 of the latch element 62. Due to a biased state of the latch element 62, the lower end 51 is in continuous contact with the beveled edge 64. Thus, by pushing the upper lever end 50 inwardly toward the bottom 20 the latch element 62 is actuated by the lower lever end 51 to retract into the housing 60, thereby clearing the opening 46 for further displacement of the brackets 44 therefrom, as is seen in FIG. 6.

A manner in which the safe 10 can be releasably attached the mounting plate 34 is as follows. In order to mount the safe 10 on the bracket, the enclosure 12 is juxtaposed with the mounting plate 34 so as to have the mounting brackets 44 aligned with the opening 46 in the bottom 16 of the safe. As a result of light pressing force, the free ends 45 of the mounting brackets 44 slide against the beveled edge 64 of the latch element 62 into the interior of the safe. Once the free ends 45 have passed the beveled edge 64, the latch element 62, due to a spring force exerted by the spring element 66, moves rearwardly over the opening 46 to press against the bodies 43 of the mounting brackets. Such position of the latch element 62 prevents the brackets from voluntary displacement from the opening 46.

In order to disengage the latch element 62 as shown in FIG. 6, the lid 14 has to be opened after the access code has been entered to enable access into the interior of the enclosure 12. Upon actuating the upper lever end 50, which has a T shape, a user pivots the release lever to displace the lower lever end 51 between the brackets toward the housing 60, thereby making the latch element 62 retract into the housing. Finally, as a result of a lifting force applied to the safe, the user is able to detach the enclosure 12 from the mounting bracket.

It is intended that the flowing claims defined the scope of the invention and the structures within the scope of these claims and their equivalents be covered thereby.

What is claimed is:

1. A safe assembly for temporary attachment to a surface and for retaining articles, comprising:

a mounting bracket adapted to be attached to the surface and extend therefrom, the mounting bracket having at least one elongated arm provided with a free end;

a lockable enclosure having an interior sized to receive the articles in its open state, the lockable enclosure further having an opening sized to receive the one arm in an engaging position between the lockable enclosure and the mounting bracket, wherein the free end is spaced outwardly from the opening and terminates in the interior of the lockable enclosure; and a latching element within the interior of the lockable enclosure and positioned with respect to the opening to releasably engage the mounting bracket in the engaging position, the latching element including a release lever having an inner end adjacent to the opening and an outer end spaced an external force to the outer end only in the open state of the lockable enclosure, and a latch plate biased toward the inner end of the release lever and continuously urging against it, the latch plate pressing against the one arm under its free end in the engaging position to prevent voluntary detachment of the mounting bracket, the inner end of the release lever displacing the latch plate from the one arm upon application of the external force to enable the free end of the one arm to slide through the opening from the interior of the lockable enclosure, so that the lockable enclosure may be detached from the mounting bracket to become portable for travel or relocation.

2. The safe assembly defined in claim 1 wherein the latching element further comprises a spring element biasing the latch plate toward and over the opening to provide continuous engagement with the inner end of the release lever.

3. The safe assembly defined in claim 2 wherein the inner end of the release lever displaces the latch plate away from the opening upon pivoting of the release lever in a position wherein the latch plate clears the opening to enable the mounting bracket to be displaced from the opening.

4. The safe assembly defined in claim 2 wherein the mounting bracket comprises a pair of spaced arms, each arm having a body extending along a longitudinal axis substantially perpendicular to the pivot axis of the release lever in the engaging position between the lockable enclosure and the mounting bracket, each of the arms being formed with a free end which has a thickness greater than a thickness of the body to enable the free end to rest atop the latch plate while it presses against the body of the spaced arms, thereby preventing the spaced arm from being displaced from the opening.

5. The safe assembly defined in claim 4 wherein each of the free ends of the spaced arms has a U shape.

6. The safe assembly defined in claim 2 wherein the latching element further comprises a housing receiving the spring element, the housing having a rear wall spaced from the opening and arresting further displacement of the latch plate after it has been displaced away from the arm by the inner end of the lever.

7. The safe assembly defined in claim 1 wherein the release lever has a Z shape, the lockable enclosure further comprising a bottom having the opening and a support extending from the bottom and having a recess which receives the outer end of the release lever.

8. The safe assembly defined in claim 7 wherein the outer end of the release lever has a T shape.

9. The safe assembly defined in claim 7 wherein the release lever has a pin extending along the pivot axis substantially midway between the inner and outer ends, the latching element further having a pair of brackets fixed to the support and receiving opposite ends of the pin which is mounted rotatably on the brackets.

10. The safe assembly defined in claim 1 wherein the lockable enclosure has a lid pivotally mounted to the lockable enclosure to swing in an open position, wherein the interior of the lockable enclosure receives the articles, the safe assembly further comprising a locking member automatically securing the lid to the lockable enclosure.

11. The safe assembly defined in claim 1 wherein the mounting bracket has a plate sized and shaped to conform to a bottom of the lockable enclosure.

12. A safe assembly for mounting on a surface and for retaining articles such as guns and the like, the safe assembly comprising:

a lockable enclosure provided with a swingable lid and having an interior, said interior receiving the articles in an unlocked state of the lockable enclosure, wherein the lid is swung open, and having a bottom provided with an opening;

a mounting bracket attached to the bottom of the lockable enclosure for mounting the lockable enclosure to the surface, the mounting bracket having at least one arm extending through the opening into the interior during attachment of the lockable enclosure to the mounting bracket;

a latching element having a release lever provided with an inner end, which is adjacent to the opening, and an outer end spaced from the opening; and a latch plate biased toward the release lever to urge against its inner end, the release lever being pivotal within the interior of said lockable enclosure to swing between a first position and a second position, wherein the the latch plate engages the arm of the mounting bracket, the release lever being actuated from the interior to swing towards its first position upon application of an external force to the outer end in the unlocked state of the lockable enclosure, so as to enable displacement of the latch plate away from the arm of the mounting bracket, so that the mounting bracket may be displaced from the opening.

13. safe assembly defined in claim 12 wherein the release lever has generally a Z-shape, and a spring element biasing the latch plate toward the release lever and over the opening in the second position of the release lever.

14. The safe assembly defined in claim 13 wherein the latch plate has a beveled end portion being in contact with the inner end of the release lever as the latch plate is displaceable toward the opening after the external force applied to the outer end of the release lever has been withdrawn.

15. The safe assembly defined in claim 12 wherein the mounting bracket includes a mounting plate shaped to conform to the bottom of the lockable enclosure and having another arm which is spaced from the one arm, the spaced arms flanking the inner end of the release lever after they have been extended through the opening.

16. The safe assembly defined in claim 15 wherein each of the arms comprises a body formed with a free end which has a thickness greater than a thickness of the body, so that free ends displace the latch plate away from the opening during insertion of the mounting bracket into the opening.

17. The safe assembly defined in claim 16 wherein the free ends of the arms are positioned on top of the latch plate while it presses against the bodies of the spaced arms in the second position of the latching element.

18. The safe assembly defined in claim 15 wherein the one and another arms have free ends, each of the free ends of the spaced one and another arms has a U shape.

19. The safe assembly defined in claim 16 wherein the mounting plate has a pair of spaced hooks formed on a rear end of the mounting plate, each of the hooks having a body extending parallel to the spaced arms and a free end which extends substantially perpendicular to the body toward the arms and releasably engages the lockable enclosure.

20. A method for mounting a safe assembly on a surface and for retaining articles such as guns and the like, the safe assembly comprising a lockable enclosure formed with an interior, a mounting bracket for mounting the lockable enclosure to the surface and having at least one arm, which extends substantially perpendicular from the mounting bracket, and a latching element in the interior of the lockable enclosure and having a release lever, which is provided with an inner end adjacent to an opening, and an opposite outer end spaced from the opening, the release lever being pivotal about a pivot axis upon applying an external force to its outer end, the latching element further having a latch plate, which is biased toward the release lever to continue engagement with the inner end of the release lever, said method comprising the steps of:

attaching the mounting bracket to the surface, said mounting bracket extending from the surface;

pressing the lockable enclosure against the mounting bracket to insert the one arm through the opening into the interior, thereby engaging the one arm with the latch plate to have the lockable enclosure releasably secured to the surface;

opening the lockable enclosure to have access to its interior; and actuating the outer end of the release lever of the latching element from the interior to displace the latch plate from the one arm of the mounting bracket thereby detaching the lockable enclosure from the surface for travel or relocation.

21. The method defined in claim 20 wherein the latching element is displaceable away from engagement with the mounting bracket to clear the opening and to enable the mounting bracket to be displaced from the opening while pressing upon the latching element.

* * * * *